US008742242B1

(12) United States Patent
Ribner

(10) Patent No.: US 8,742,242 B1
(45) Date of Patent: Jun. 3, 2014

(54) DRUM TUNING PROCESSOR

(71) Applicant: David Byrd Ribner, Andover, MA (US)

(72) Inventor: David Byrd Ribner, Andover, MA (US)

(73) Assignee: Overtone Labs, Inc., Lawrence, MA (US)

( * ) Notice: Subject to any disclaimer, the term of this patent is extended or adjusted under 35 U.S.C. 154(b) by 0 days.

(21) Appl. No.: 13/886,342

(22) Filed: May 3, 2013

Related U.S. Application Data

(60) Provisional application No. 61/739,199, filed on Dec. 19, 2012.

(51) Int. Cl.
*G10G 7/02* (2006.01)

(52) U.S. Cl.
USPC ..... 84/454

(58) Field of Classification Search
USPC ..... 84/454
See application file for complete search history.

(56) References Cited

U.S. PATENT DOCUMENTS

| | | | | |
|---|---|---|---|---|
| 4,023,462 | A * | 5/1977 | Denov et al. | 84/454 |
| 7,968,780 | B2 * | 6/2011 | Millender et al. | 84/411 R |
| 8,203,063 | B2 | 6/2012 | Truda | |
| 2011/0179939 | A1 * | 7/2011 | Ribner | 84/454 |

* cited by examiner

*Primary Examiner* — Jianchun Qin
(74) *Attorney, Agent, or Firm* — Schmeiser Olsen & Watts LLP

(57) ABSTRACT

A processor of a tuning apparatus receives a desired fundamental frequency or note and determines a frequency or note of at least one drumhead of a drum in response to the received desired fundamental frequency or note. An output at the processor outputs a value corresponding to the determined frequency or note of the drumhead.

24 Claims, 3 Drawing Sheets

DRUM TUNING PROCESSOR

RELATED APPLICATIONS

This application claims priority to U.S. Provisional Application Ser. No. 61/739,199, filed on Dec. 19, 2012 entitled "Drum Tuning Processor," the entirety of which is incorporated by reference herein.

This application is related to U.S. patent application Ser. No. 13/004,166, filed on Jan. 11, 2011, and published as U.S. Patent Application Publication No. US-2011-0179939, entitled "Drum and Drum-Set Tuner," U.S. patent application Ser. No. 13/688,822, filed Nov. 12, 2012, entitled "Drum and Drum-Set Tuner," U.S. Provisional Patent Application Ser. No. 61/699,559, filed on Sep. 11, 2012 entitled "Timpani Tuning and Pitch Control System," and U.S. patent application Ser. No. 13/768,799, filed on Feb. 15, 2013, entitled "Drum and Drum-Set Tuner," and issued as U.S. Pat. No. 8,502,060 on Aug. 6, 2013, the contents of each of which is incorporated by reference herein in its entirety.

BACKGROUND

Drums or related percussion instruments can be difficult to tune. For example, the fundamental frequency of a two-headed drum can be varied by adjusting either the top or bottom heads, resulting in an infinite number of drumhead frequency combinations for a given fundamental frequency.

One important requirement with respect to drum tuning is for each drumhead to be tuned uniformly, that is, to produce the same frequency when tapped near each tuning lug near the edge. Another requirement is for the drum to have the desired fundamental frequency when tapped near the center. A third requirement is to maintain a specific frequency relationship between top and bottom heads in order to control other aspects of the drum sound so it is preferable to raise or lower the frequency of both heads to adjust the fundamental frequency. However, it is time-consuming to tune a drumhead uniformly. Even after both drumheads are in tune with themselves, i.e., tuned uniformly, the resulting fundamental frequency may be inadequate or incorrect. If so, then one or both heads must typically be re-adjusted until the desired fundamental frequency is achieved. Conventional tuning techniques consequently entail a time-consuming trial and error process.

BRIEF SUMMARY

In accordance with an aspect of the present inventive concepts, provided is a drum tuning processor that determines top and bottom drumhead frequencies according to a determined relationship between the fundamental frequency and a frequency, or lowest overtone frequency (LOF), of the top and bottom drumheads, respectively. Accordingly, a drum can be tuned to a specific fundamental frequency according to a calculated result provided by the drum tuning processor. The drum tuning processor can include parameters to control the resonance of the drum or the musical interval between either a fundamental frequency and that of the top and/or bottom head, or between the top and bottom heads.

In accordance with an aspect of the present inventive concepts, provided is a tuning apparatus, comprising: a processor that receives a desired fundamental frequency or note and determines a frequency of at least one drumhead of a drum in response to the received desired fundamental frequency or note; and a display that presents a value corresponding to the determined frequency of the at least one drumhead.

In accordance with another aspect of the present inventive concepts, provided is a drum tuning system comprising: a tuning processor that receives a desired fundamental frequency or note and determines a frequency of each of a top drumhead and a bottom drumhead of a drum in response to the received desired fundamental frequency or note; an input device that presents the desired fundamental frequency or note to the tuning processor; a frequency measuring device that measures a frequency of the drum in response to an excitation of the drum; and a display that displays at least one of a determined frequency and a measured frequency in response to the excitation of the drum.

In accordance with another aspect of the present inventive concepts, provided is a method for calibrating a drum tuning processor, comprising: selecting a desired frequency of each of a top drumhead and a bottom drumhead of a drum; tuning the top and bottom drumheads according to the desired frequency of the each of the top and bottom drumheads; and determining a fundamental frequency of the drum and a drum tuning coefficient.

DETAILED DESCRIPTION

When struck, a two-headed drum can vibrate in a number of different modes. The fundamental mode generated by the top and bottom drumheads vibrating together in unison, for example, via acoustic coupling, is the lowest frequency of a periodic waveform related to the output of the struck drum, and is typically the loudest tone produced by the drum. Higher modes can also be generated by the top and bottom drumheads and result in higher frequency overtones. The specific combination of fundamental and higher overtones depends on where the drumhead is struck, for example, near the center, which excites the fundamental mode, or striking near the edge, which excites the LOF.

Figure 1:
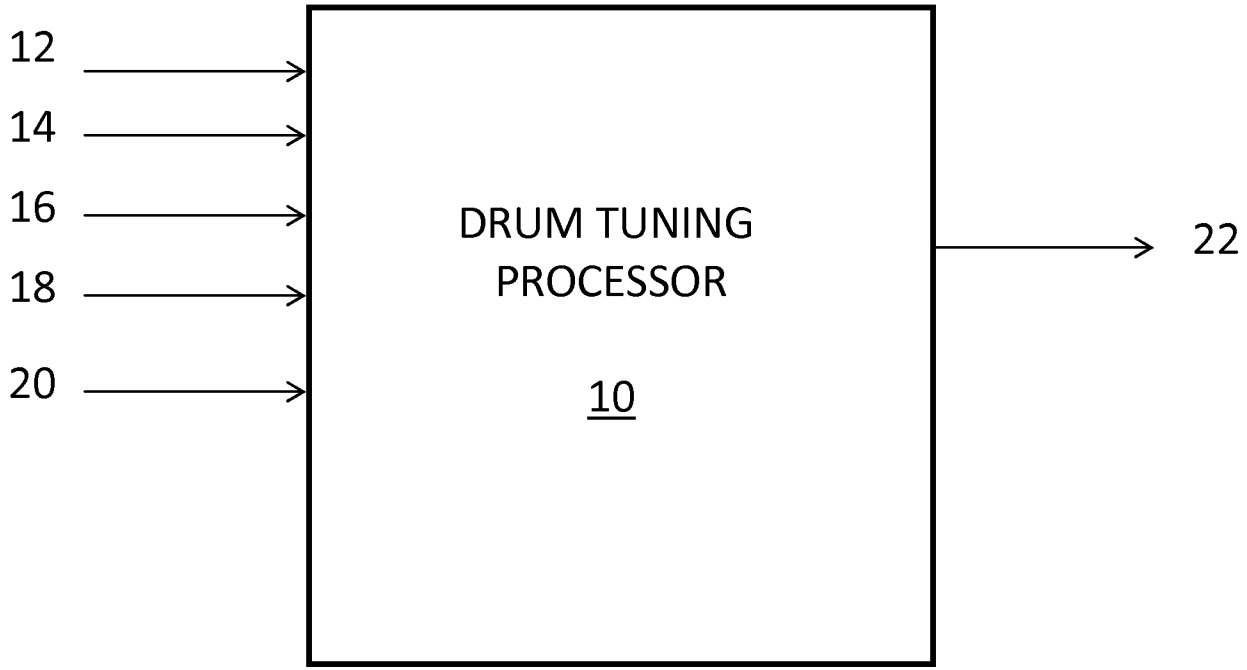
FIG. 1 shows a block diagram of a drum tuning processor, in accordance with an embodiment.

FIG. 1 shows a block diagram of a drum tuning processor 10 in accordance with an embodiment. The drum tuning processor 10 determines for a user one or more recommended frequencies, or notes, at which one or more drumheads can be tuned in order to produce a fundamental frequency or note for the drum desired by the user. The recommended frequencies or notes can include lower overtone frequencies or notes.

In an embodiment, the fundamental frequency f0of a two-headed drum depends on the lowest frequency overtones of the top head ft and the bottom head fb according to the following equation $$f0=a\sqrt{ftfb} \tag{1}$$

where $a$ can be a constant at or about a value of 0.581 for a typical tom-tom drum. It is evident from equation (1) that the LOF of each of the top and bottom drumheads can have an equivalent influence on the fundamental frequency of the drum. Furthermore it is evident that there are two degrees of freedom in equation (1) and, therefore, there are an infinite number of top and bottom drumhead LOFs for a given fundamental frequency. By introducing a constraint in the relationship between these frequencies, it is possible to arrive at a single solution for the equation. Embodiments herein describe several constraints, but are not limited thereto. These constraints can be user-defined. These constraints can be mutually exclusive such that one constraint at a time can be used. The tuning processor 10, or calculator, can for a desired f0calculate LOFs for ft and fb. When the top and bottom drumheads of an actual drum are tuned to those LOFs, the drum will have a resulting fundamental frequency close to or at the desired f0. This is an approach for directly tuning the actual f0of a real drum to a value desired by the user. As described again, the systems and methods in accordance with embodiments can solve for ft and fb for a given f0subject to a constraint. A user can subsequently tune a drum by tapping the drum near each lug and tuning an LOF of the top and bottom drumheads, respectively, according to the frequencies determined by the tuning processor 10. For example, a user can first measure and adjust the top head LOF to be at or close to ft and likewise measure and adjust the bottom head to be at or close to fb prior to measuring the fundamental frequency. The drum after tuning in accordance with these predetermined frequency calculations can have its top and bottom heads uniformly tuned and can have a fundamental frequency close to or at the desired fundamental frequency, which can save considerable time compared to a conventional trial and error approach.

Figure 2:
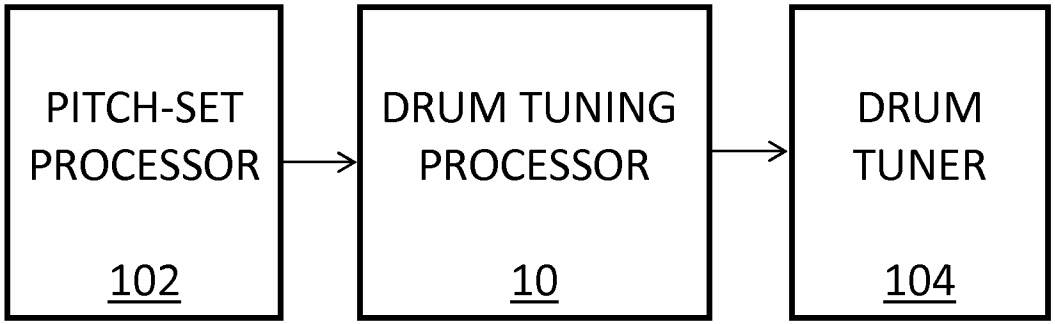
FIG. 2 is a detailed block diagram of a system including the drum tuning processor of FIG. 1, in accordance with an embodiment.
Figure 3:
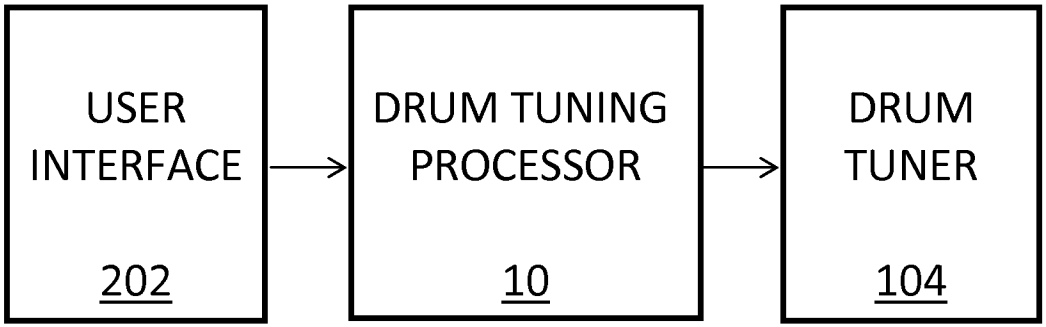
FIG. 3 is a detailed block diagram of a system including the drum tuning processor of FIG. 1, in accordance with another embodiment.

In an embodiment, the tuning processor 10 is implemented in hardware and/or software such that it solves equation (1) for a specific fundamental frequency or musical note subject to a parameterized constraint and displays the resulting ft and fb to guide a user in tuning a drum. In an embodiment, as shown in FIG. 3, a fundamental frequency f0or note 12 is input by a user interface 202. In another embodiment, as shown in FIG. 2, a fundamental frequency f0or note 12 is provided by a pitch-set processor 102 that is used for specifying the frequencies for several drums in some musical relationship, for example musical intervals. An example of a pitch-set processor 102 is described at U.S. patent application Ser. No. 13/004,166, filed on Jan. 11, 2011, and published as U.S. Patent Application Publication No. US-2011-0179939, entitled "Drum and Drum-Set Tuner," incorporated by reference above. For example, the pitch-set processor 102 can select a fundamental frequency or note, of each drum in a set based on user criteria, such as sizes and number of drums in the drum-set, the type of tuning desired, such as a chord, interval, type of sound, and so on. The pitch-Set processor 102 then presents, for example, displays, the selected fundamental frequency or note for each drum in the drum set. In addition to the fundamental frequency or musical note 12, several other inputs from a user interface and/or a pitch-set processor can be supplied to the drum tuning processor 10, for example, shown in FIG. 1. For example, the pitch-set processor 102 of FIG. 2 can include preset or stored mode data, such as a mode parameter value.

The tuning processor 10 includes a mode input 14 that can specify a frequency relationship between LOFs and/or a fundamental frequency. In an embodiment, a mode can include a resonant mode, or a ratio of f0to a difference of fb and ft, for example, shown at equation (2). In another embodiment, a mode can include a top to fundamental interval mode, or an interval between ft and f0. In another embodiment, a mode can include a bottom to top interval mode, or an interval between fb and ft.

A mode parameter input 16 can include a data value associated with the selected mode at mode input 14. A mode parameter value can include at least one of: (1) a resonance R, (2) an interval g or (3) an interval k, each described in greater detail below.

The tuning processor 10 includes a highest drumhead input 18, where a user can specify, for example, from a user interface or the like, which drumhead is desired to have a higher LOF. The tuning processor 10 can include a head select input 20 for specifying which head is being tuned, i.e., the top head or bottom heat. The head select input 20 can be processed by the tuning processor 10 to establish whether ft or fb is provided from the output 22 of the tuning processor 10 to the user interface to be displayed as the reference frequency. Alternatively, the difference between a recently determined tuner frequency measurement and the selected reference frequency, ft or fb, is displayed if the associated drum tuner is in a difference mode, for example, described in U.S. patent application Ser. No. 13/688,822, filed Nov. 12, 2012, entitled "Drum and Drum-Set Tuner," incorporated by reference above.

In the embodiments shown in FIGS. 2 and 3, a drum tuner 104 can permit the tuning of a drum to the LOFs determined by a tuning processor 10. The LOFs determined by the tuning processor 10 can be displayed along with a measured drum frequency from the drum tuner 104. Alternatively the determined LOF frequency and the difference in the measured and determined frequency can be displayed.

In an embodiment, the tuning processor 10 can be part of a drum tuner or other tuning aid to permit a user to determine required drumhead LOFs and to measure the drumhead LOFs as they adjust various lug tensions of a drum. Examples of a drum tuner can include but not be limited to those described with reference U.S. patent application Ser. No. 13/004,166, filed on Jan. 11, 2011, and published as U.S. Patent Application Publication No. US-2011-0179939, entitled "Drum and Drum-Set Tuner," U.S. patent application Ser. No. 13/688,822, filed Nov. 12, 2012, entitled "Drum and Drum-Set Tuner," U.S. Provisional Patent Application Serial No. and U.S. patent application Ser. No. 13/768,799, filed on Feb. 15, 2013, entitled "Drum and Drum-Set Tuner," the contents of each of which is incorporated by reference above. In an embodiment, a difference mode of operation can be implemented where the difference between a measured frequency and the desired LOF is displayed, for example, described above. With this feature, the user simply can adjust the tuning lugs until a reading close to zero is displayed. In other embodiments, the tuning processor 10 is incorporated into a web-site application, a computer application or a mobile application, or other application stored on volatile or non-volatile memory and executed on a processor. One or more of the foregoing embodiments permit a user to tune drums with a tuner.

Depending on the mode input 14, the drum tuning processor 10 can compute at least one of three sets of equations corresponding to three alternative frequency constraints for solving equation 1 above. Although these constraints are considered relevant for drum tuning and are described in the following section, the drum tuning processor 10 is not limited to the constraints described herein, and other constraints are thereby applicable. In an embodiment, it is assumed that the bottom drumhead LOF is greater than or equal to the top drumhead LOF, i.e., $fb \geq ft$ in a formulation herein. In alternative cases where $ft > fb$, ft and fb can be interchanged in one or more equations herein.

As described above, a constraint can relate to a mode, referred to as Mode 1, that includes setting the ratio of the fundamental frequency to the difference of the LOF of top and bottom drumheads to a constant. This constraint is useful for controlling the resonance of a drum. A maximum resonance can be obtained when the top and bottom drumhead LOFs are equal whereas a lower resonance is obtained with them separated in frequency. The equation for this constraint is:

$$R = \frac{f0}{fb - \mathrm{ft}} \tag{2}$$

where R is the resonance parameter. Solving equation (1) subject to the constraint established in equation (2) results in:

$$\mathrm{ft} = \frac{fo}{2R}\left[\sqrt{1 + \left(\frac{2R}{a}\right)^2} - 1\right] \tag{3}$$

$$fb = \frac{fo}{2R}\left[\sqrt{1 + \left(\frac{2R}{a}\right)^2} + 1\right] \tag{4}$$

The following table shows typical values of the resonance parameter R for user inputs. For example, when a user selects "High Resonance" from a user interface, for example, displayed at a website, the "High Resonance" selection can correspond to a value of R=4, which is used to solve an equation herein, for example, equation (3) or (4).

| User Resonance Selection | R |
|---|---|
| Low | 1 |
| Medium | 2 |
| High | 4 |
| Maximum | >1000 (Infinity) |

Another constraint can relate to a different mode, referred to as Mode 2, that includes setting the ratio of the LOF of the top or bottom drumhead to the fundamental frequency to a constant. This constraint allows the two loudest tones produced by a drum to be at a particular musical interval. For example, a user may desire to have the fundamental and the LOF of the top drumhead to be in a frequency ratio of 3 to 2, that is, a perfect fifth in music terminology. The equation for this constraint is:

$$\mathrm{ft} = g\mathrm{f0} \tag{5}$$

where, $$\left(\frac{1}{a} > g > 1\right)$$

is a parameter that controls the frequency ratio of the top head to the fundamental frequency. Solving equation (1) subject to this constraint results in:

$$fb = \frac{f0}{a^2 g} \tag{6}$$

Another constraint can relate to a different mode, referred to as Mode 3, that includes setting the ratio of the LOF of top and bottom drumheads to a constant. This constraint allows the LOFs of top and bottom drumheads to be at a particular musical interval. The equation for this constraint is:

$$\mathrm{fb} = k\mathrm{ft} \tag{7}$$

where, (k>1) is a parameter that controls the frequency ratio of the top and bottom heads. Solving equation (1) subject to this constraint results in $$\mathrm{ft} = \frac{f0}{a\sqrt{k}} \tag{8}$$

$$fb = \frac{\sqrt{k}\, f0}{a} \tag{9}$$

The following table shows typical values of g or k for user interval selections.

| User Interval Selection | g or k |
|---|---|
| Full Step | 1.123 |
| Minor Third | 1.189 |
| Major Third | 1.26 |
| Perfect Fourth | 1.33 |
| Perfect Fifth | 1.50 |

The drum tuning coefficient *a* in equation (1) varies somewhat from drum to drum depending on the ratio of the drum diameter to depth and the type of drumheads. To accommodate drum variability, the drum tuning processor 10 incorporates an optional calibration mode where the tuning coefficient can be measured for any drum. In a calibration mode, after uniformly tuning the top and bottom LOFs of a drum, the fundamental frequency and top and bottom LOFs can be determined and stored, for example, at a storage device such as a computer disk drive, a volatile or non-volatile memory, or other storage element known to those of ordinary skill in the art. Then after selecting a request to calibrate with the user interface, the value of *a* can be computed by the drum tuning processor 10 according to equation (1). After the calibration operation is performed, the computed value of *a* is used for subsequent tuning computations for the specific drum to thereby improve the accuracy of the resulting ft and fb reference frequencies. In another embodiment, a predetermined value, for example, *a*=0.581 (see above), can be applied for reasonable accuracy, obviating the need for calibration.

What is claimed is:

1. A tuning apparatus, comprising:

a processor that receives a desired fundamental frequency or note and determines a frequency or note of at least one drumhead of a drum in response to the received desired fundamental frequency or note, wherein the processor further receives and processes mode data to the processor, the mode data establishing a frequency relationship between at least two of a lowest overtone frequency or note of a top drumhead of the drum, a lowest overtone frequency or note of a bottom drumhead of the drum or a fundamental frequency or note of the drum; and an output at the processor that outputs a value corresponding to the determined frequency or note of the at least one drumhead.

2. The tuning apparatus of claim 1, wherein the determined frequency or note of each drumhead includes frequencies of the lowest overtones of the top and bottom drumheads, respectively.

3. The tuning apparatus of claim 1, wherein the desired fundamental frequency or note is received by the processor from a user interface.

4. The tuning apparatus of claim 1, wherein the desired fundamental frequency or note is determined from a pitch-set processor.

5. The tuning apparatus of claim 1, wherein an actual fundamental frequency is modified to be at or close to the desired fundamental frequency according to the determined frequency of the drumhead after tuning the at least one drumhead.

6. The tuning apparatus of claim 1, wherein the mode data is received by the processor from a user interface or a pitch-set processor.

7. The tuning apparatus of claim 6, wherein the mode data includes a mode type and a mode parameter value.

8. The tuning apparatus of claim 1, wherein the received mode data includes a user-defined resonance constraint parameter that controls a ratio of the desired fundamental frequency or note and a difference between frequencies of two or more drumheads of the at least one drumhead, the processor determining the frequencies or notes of the two or more drumheads from the user-specified resonance constraint parameter and the desired fundamental frequency or note.

9. The tuning apparatus of claim 1, wherein the received mode data includes an interval constraint parameter that controls a frequency ratio of a top drumhead and the desired fundamental frequency or note, the processor determining the frequency or note of each drumhead from the interval constraint parameter and the desired fundamental frequency or note.

10. The tuning apparatus of claim 1, wherein the received mode data includes an interval constraint parameter that controls a frequency ratio of a top drumhead and a bottom drumhead, the processor determining the frequency or note of each drumhead from the interval constraint parameter and the desired fundamental frequency or note.

11. The tuning apparatus of claim 1, wherein the processor computes a tuning coefficient according to a ratio of a fundamental frequency of the drum and the square-root of the product of frequencies of two or more drumheads of the at least one drumhead.

12. The tuning apparatus of claim 1, wherein the output outputs at least one of a determined frequency or note of the at least one drumhead and a measured frequency or note in response to receiving the value.

13. The tuning apparatus of claim 1, wherein the output outputs at least one of a determined frequency or note of the drumhead and a calculated difference between a measured frequency or note and the determined frequency or note.

14. A drum tuning system comprising:

a tuning processor that receives a desired fundamental frequency or note and determines a frequency or note of each of a top drumhead and a bottom drumhead of a drum in response to the received desired fundamental frequency or note;

an input that presents the desired fundamental frequency or note to the tuning processor;

a frequency measuring device that measures a frequency of the drum in response to an excitation of the drum; and an output that outputs at least one of a determined frequency or note and a measured frequency in response to the excitation of the drum, wherein the tuning processor further receives and processes mode data to the tuning processor, the mode data establishing a frequency relationship between at least two of a lowest overtone frequency or note of the top drumhead of the drum, a lowest overtone frequency or note of the bottom drumhead of the drum or the fundamental frequency or note of the drum.

15. The drum tuning system of claim 14, wherein the tuning processor determines a difference between a measured frequency and the determined frequency or note of at least one drumhead of the top drumhead and the bottom drumhead.

16. The drum tuning system of claim 14, wherein the input includes a user interface.

17. The drum tuning system of claim 14, wherein the input includes a pitch-set processor.

18. The drum tuning system of claim 14, wherein the determined frequency or note of each of the top and bottom drumheads includes a lowest overtone frequency.

19. The drum tuning system of claim 14, wherein the output outputs a measured fundamental frequency that is at or close to the desired fundamental frequency according to the determined frequency or note of the drumheads in response to a drum tuning adjustment.

20. The drum tuning system of claim 19, wherein the drum tuning adjustment includes tuning the top and bottom drumheads to lowest overtone frequencies determined by the tuning processor.

21. The drum tuning system of claim 14, wherein the input outputs to the tuning processor a user-defined resonance constraint parameter that controls a ratio of the desired fundamental frequency or note and a difference between frequencies of the drumheads, the processor determining the frequency of each drumhead from the user-specified resonance constraint parameter and the desired fundamental frequency or note.

22. The drum tuning system of claim 14, wherein the input outputs to the tuning processor an interval constraint parameter that controls a frequency ratio of the top drumhead and the desired fundamental frequency or note, the processor determining the frequency or note of each drumhead from the interval constraint parameter and the desired fundamental frequency or note.

23. The drum tuning system of claim 14, wherein the input outputs to the tuning processor an interval constraint parameter that controls a frequency ratio of the top drumhead and the bottom drumhead, the processor determining the frequency or note of each drumhead from the interval constraint parameter and the desired fundamental frequency or note.

24. The drum tuning system of claim 14, wherein the tuning processor computes a tuning coefficient according to a ratio of a fundamental frequency of the drum and the square-root of the product of measured frequencies of the drumheads.

* * * * *